US006481495B1

(12) United States Patent
Evans

(10) Patent No.: US 6,481,495 B1
(45) Date of Patent: Nov. 19, 2002

(54) DOWNHOLE TOOL WITH ELECTRICAL CONDUCTOR

(76) Inventor: Robert W. Evans, 18740 Palm Beach Blvd., Montgomery, TX (US) 77356

( * ) Notice: Subject to any disclaimer, the term of this patent is extended or adjusted under 35 U.S.C. 154(b) by 5 days.

(21) Appl. No.: 09/669,458

(22) Filed: Sep. 25, 2000

(51) Int. Cl.[7] ..... E21B 31/107
(52) U.S. Cl. ..... 166/65.1; 166/178; 175/321
(58) Field of Search ..... 166/65.1, 178, 166/301, 66.7, 381; 175/202, 320, 321

(56) References Cited

U.S. PATENT DOCUMENTS

| | | | |
|---|---|---|---|
| RE3,510 | E | 6/1869 | Bryan |
| RE9,072 | E | 2/1880 | McMullen |
| RE15,760 | E | 2/1924 | Kammerdiner |
| 2,093,794 | A | 9/1937 | Baptie |
| 2,499,695 | A | 3/1950 | Storm |
| RE23,354 | E | 4/1951 | Storm |
| 2,551,868 | A | 5/1951 | Brady |
| 2,659,576 | A | 11/1953 | Linney |
| 2,706,616 | A | 4/1955 | Osmun |
| 2,801,595 | A | 8/1957 | Knabe et al. |
| 2,915,289 | A | 12/1959 | Lawrence |
| 2,989,132 | A | 6/1961 | Dowden |
| 3,145,787 | A | 8/1964 | Brown |
| 3,208,541 | A | 9/1965 | Lawrence |
| 3,233,690 | A | 2/1966 | Lawrence |
| 3,251,426 | A | 5/1966 | Lebourg |
| 3,268,003 | A | 8/1966 | Essary |
| 3,285,353 | A | 11/1966 | Young |
| 3,307,636 | A | 3/1967 | Le Blanc |
| 3,316,986 | A | 5/1967 | Orr |
| 3,342,266 | A | 9/1967 | Le Blanc |
| 3,343,606 | A | 9/1967 | Dollison |
| 3,349,858 | A | 10/1967 | Chenoweth |
| 3,360,060 | A | 12/1967 | Kinley et al. |
| 3,361,220 | A | 1/1968 | Brown |
| 3,371,730 | A | 3/1968 | Newman |
| 3,380,247 | A | 4/1968 | Colmerauer |
| 3,385,384 | A | 5/1968 | Plunk |
| 3,392,795 | A | 7/1968 | Greer |
| 3,399,740 | A | 9/1968 | Barrington |
| 3,399,741 | A | 9/1968 | Monroe |
| 3,406,770 | A | 10/1968 | Arterbury et al. |
| 3,417,822 | A | 12/1968 | Howell |
| 3,429,389 | A | 2/1969 | Barrington |
| 3,446,283 | A | 5/1969 | Baumstimler |

(List continued on next page.)

FOREIGN PATENT DOCUMENTS

| | | | | |
|---|---|---|---|---|
| CA | 1221960 | | 5/1987 | ..... 255/29 |
| GB | 2193239 | A * | 2/1988 | |

OTHER PUBLICATIONS

Impact Selector, Inc.; *Impact Tools Sales Brochure*; all; Unknown Date.

Taylor Made Oil Tools, Co.; *Taylor Electric Line Jar Sales Brochure*; all; Dec. 1, 1999.

*Primary Examiner*—Frank S. Tsay
(74) *Attorney, Agent, or Firm*—Timothy M. Honeycutt

(57) ABSTRACT

Various embodiments of a downhole tool with a telescoping conductor member are provided. In one aspect, a downhole tool is provided that includes and a mandrel telescopically positioned in the housing. The mandrel and the housing define a pressure compensated substantially sealed chamber containing a volume of a non-conducting fluid. A conductor member is positioned in the housing for providing an electrically conducting pathway. The conductor member has a first segment and a second segment. The first segment is moveable with the mandrel and relative to the second segment. A portion of the conductor member is electrically insulated from an ambient fluid by the non-conducting fluid. A first biasing member is provided for maintaining a conducting pathway between the first segment and the second segment. The tool provides for electrical transmission in a telescoping tool.

41 Claims, 12 Drawing Sheets

U.S. PATENT DOCUMENTS 3,461,962 A 8/1969 Harrington
3,539,025 A 11/1970 Sutliff et al.
3,562,807 A 2/1971 Slator et al.
3,566,981 A 3/1971 Love
3,642,069 A 2/1972 Adkins
3,648,786 A 3/1972 Chenoweth
3,651,867 A 3/1972 Baumstimler
3,658,140 A 4/1972 Berryman
3,660,990 A 5/1972 Zerb et al.
3,684,042 A 8/1972 Graff
3,685,598 A 8/1972 Nutter
3,685,599 A 8/1972 Kisling, III
3,709,478 A 1/1973 Kisling, III
3,716,109 A 2/1973 Griffith ..... 175/297
3,724,576 A 4/1973 Roberts
3,727,685 A 4/1973 Chestnut et al.
3,729,058 A 4/1973 Roberts
3,735,827 A 5/1973 Berryman
3,768,932 A 10/1973 Svercl et al.
3,797,591 A 3/1974 Berryman
3,800,876 A 4/1974 Eggleston
3,804,185 A 4/1974 Mason
3,834,471 A 9/1974 Bottoms
3,837,414 A 9/1974 Swindle
3,853,187 A 12/1974 Sutliff et al.
3,860,076 A 1/1975 White
3,877,530 A 4/1975 Downen
3,880,249 A 4/1975 Anderson
3,889,766 A 6/1975 Sutliff et al.
3,942,373 A * 3/1976 Rogers ..... 166/255 X
RE28,768 E 4/1976 Mason
3,949,821 A 4/1976 Raugust
3,955,634 A 5/1976 Slator et al.
3,963,081 A 6/1976 Anderson et al.
3,987,858 A 10/1976 Slator et al.
3,994,163 A 11/1976 Rogers
4,004,643 A 1/1977 Newman
4,007,798 A 2/1977 Gazda
4,023,630 A 5/1977 Perkin et al.
4,036,312 A 7/1977 DeLuish
4,059,167 A 11/1977 Berryman
4,081,043 A 3/1978 Juergens
4,098,338 A 7/1978 Perkins
4,105,070 A 8/1978 Lavigne et al.
4,105,082 A 8/1978 Cheek
4,109,736 A 8/1978 Webb et al.
4,111,271 A 9/1978 Perkins
4,113,038 A 9/1978 Clark
4,124,245 A 11/1978 Kuenzel
4,142,597 A 3/1979 Johnston
4,179,002 A 12/1979 Young
4,181,186 A 1/1980 Blanton
4,186,807 A 2/1980 Sutliff et al.
4,210,214 A 7/1980 Blanton
4,211,293 A 7/1980 Blanton
4,226,289 A 10/1980 Webb et al.
4,230,197 A 10/1980 Wenzel
4,241,797 A 12/1980 Allen, Jr.
4,281,726 A * 8/1981 Garrett ..... 175/321
4,284,153 A 8/1981 Reaugh
4,333,542 A 6/1982 Taylor
4,341,272 A 7/1982 Marshall
4,346,770 A 8/1982 Beck
4,361,195 A 11/1982 Evans
4,376,468 A 3/1983 Clark
4,394,883 A 7/1983 Briscoe
4,494,615 A 1/1985 Jones
4,498,548 A 2/1985 Teng
4,566,546 A 1/1986 Evans
4,582,148 A 4/1986 Walter
4,607,692 A 8/1986 Swart
4,646,830 A 3/1987 Templeton
4,688,649 A 8/1987 Buck
4,736,797 A 4/1988 Restarick, Jr. et al.
4,806,928 A * 2/1989 Veneruso ..... 340/856
4,865,125 A 9/1989 De Cuir
4,919,219 A 4/1990 Taylor
4,923,373 A 5/1990 Rothaar et al.
5,007,479 A 4/1991 Pleasants et al.
5,022,473 A 6/1991 Taylor
5,069,282 A 12/1991 Taylor
5,085,479 A 2/1992 Taylor
5,086,853 A 2/1992 Evans
5,103,903 A 4/1992 Marks, II
5,123,493 A 6/1992 Wenzel
5,156,211 A 10/1992 Wyatt
5,170,843 A 12/1992 Taylor
5,217,070 A 6/1993 Anderson
5,232,060 A 8/1993 Evans
5,318,139 A 6/1994 Evans
5,327,982 A 7/1994 Trahan et al.
5,507,347 A 4/1996 Estilette, Sr.
5,624,001 A 4/1997 Evans
5,947,198 A * 9/1999 McKee et al. ..... 166/66.4
6,098,727 A * 8/2000 Ringgenberg et al. ... 175/325.2
6,230,812 B1 * 5/2001 Reaux ..... 166/378
6,290,004 B1 * 9/2001 Evans ..... 175/296

* cited by examiner

FIG. 1E
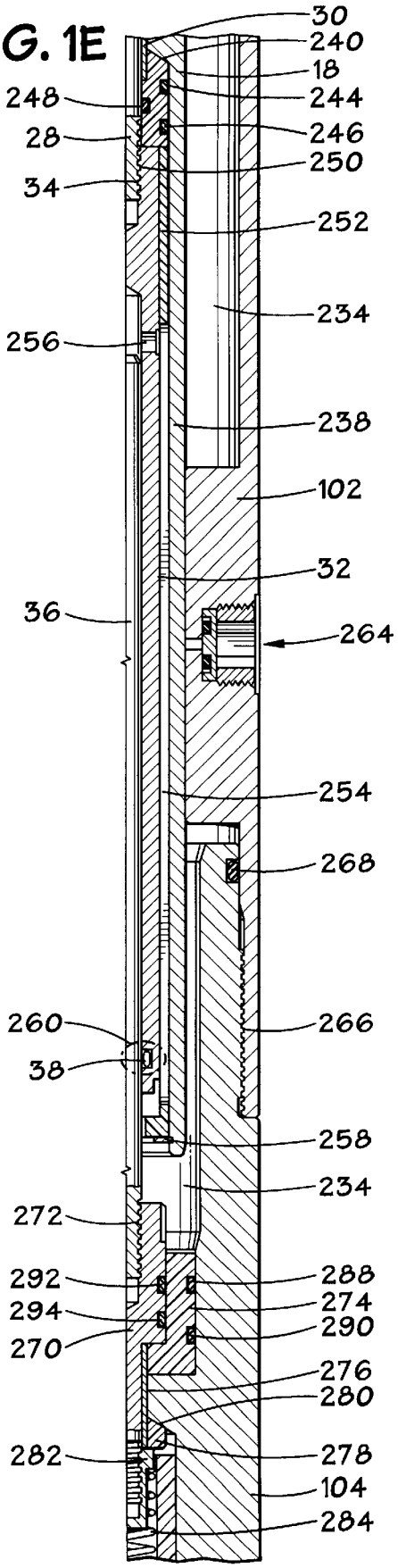
FIG. 1F
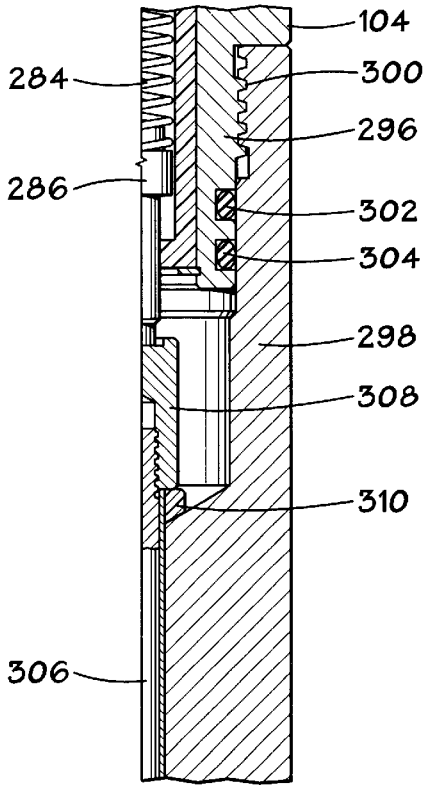
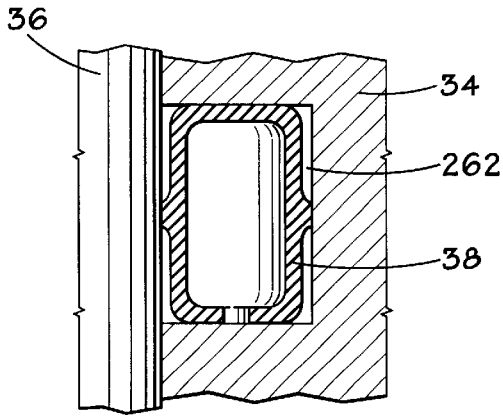
FIG. 5

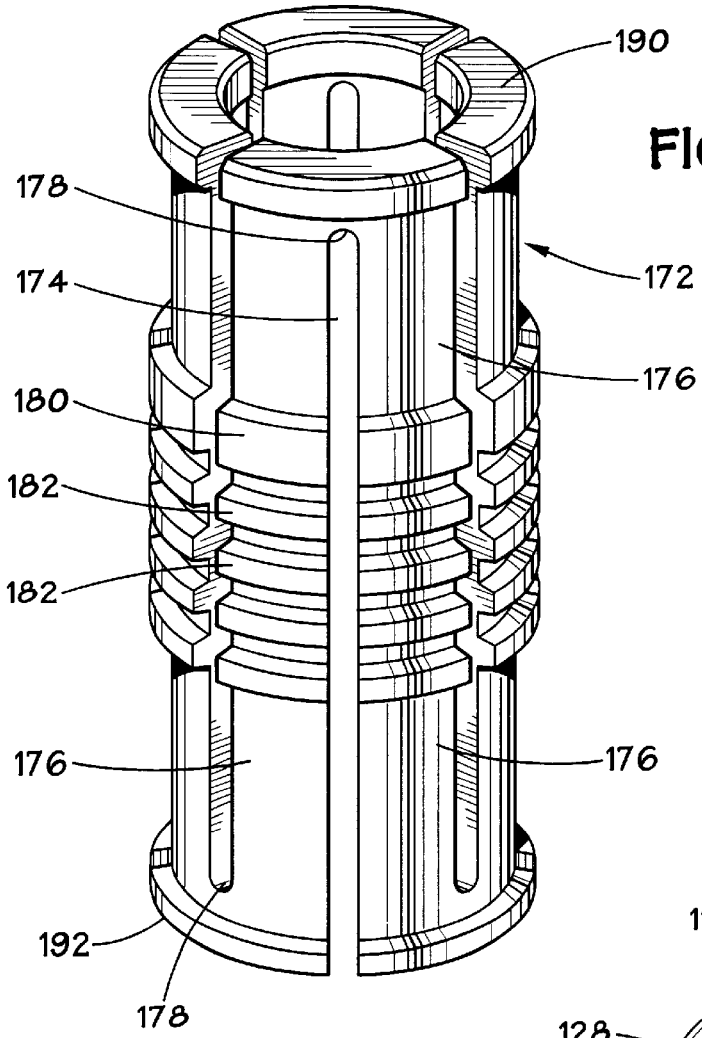
FIG. 3
FIG. 2
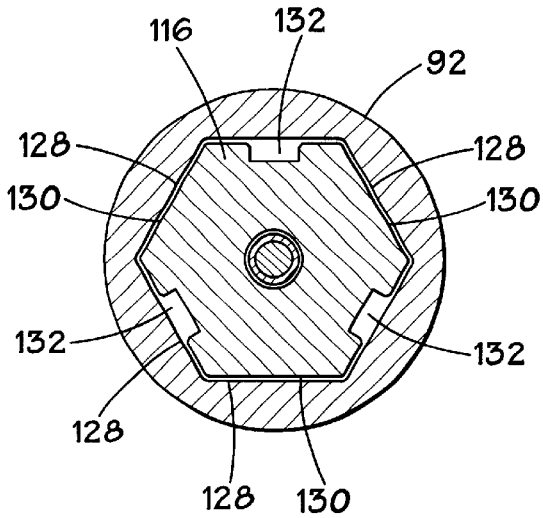
FIG. 4
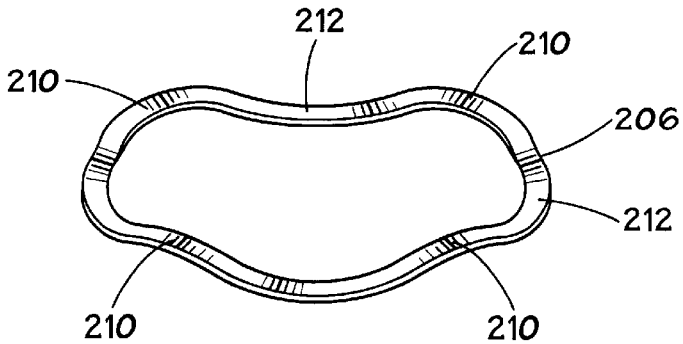

10'''
374
378
370
376
372
364
386
362
12
352
158
16
14
360
170
360
120

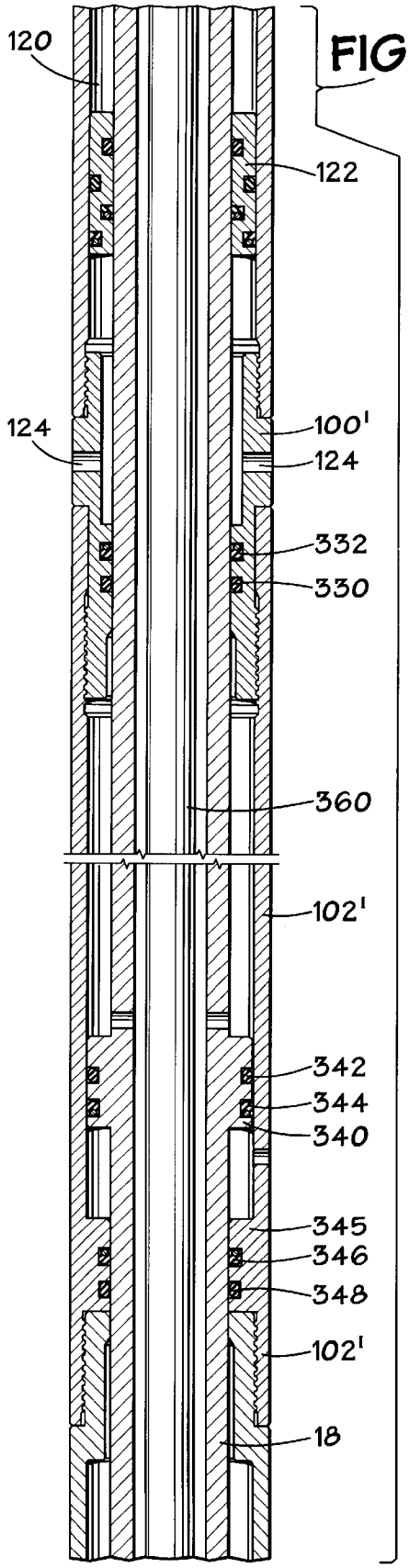
FIG. 11C
FIG. 11D
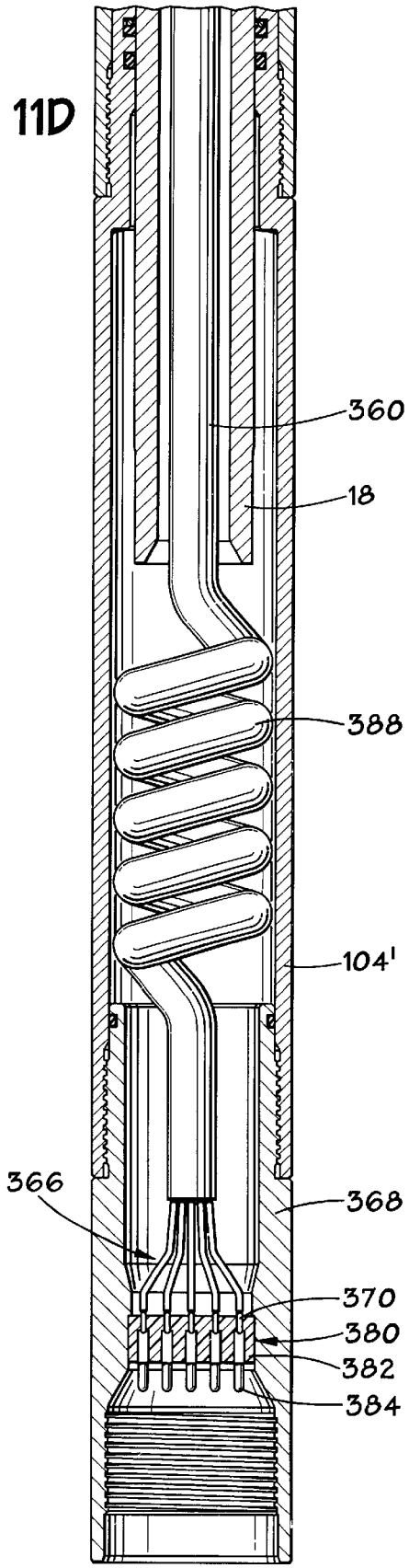

DOWNHOLE TOOL WITH ELECTRICAL CONDUCTOR

BACKGROUND OF THE INVENTION

1. Field of the Invention

This invention relates generally to downhole tools, and more particularly to a jar that is operable to impart axial force to a downhole string and that is equipped with a conductor for carrying electrical current.

2. Description of the Related Art

In oil and gas well operations, it is frequently necessary to inflict large axial blows to a tool or tool string that is positioned downhole. Examples of such circumstances are legion. One situation frequently encountered is the sticking of drilling or production equipment in a well bore to such a degree that it cannot be readily dislodged. Another circumstance involves the retrieval of a tool or string downhole that has been separated from its pipe or tubing string. The separation between the pipe or tubing and the stranded tool or "fish" may be the result of structural failure or a deliberate disconnection initiated from the surface.

Jars have been used in petroleum well operations for several decades to enable operators to deliver such axial blows to stuck or stranded tools and strings. There are a few basic types. So called "drilling jars" are frequently employed when either drilling or production equipment has become stuck to such a degree that it cannot be readily dislodged from the well bore. The drilling jar is normally placed in the pipe string in the region of the stuck object and allows an operator at the surface to deliver a series of impact blows to the drill string via a manipulation of the drill string. These impact blows to the drill string are intended to dislodge the stuck object and permit continued operation. So called "fishing jars" are inserted into the well bore to retrieve a stranded tool or fish. Fishing jars are provided with a mechanism that is designed to firmly grasp the fish so that the fishing jar and the fish may be lifted together from the well. Many fishing jars are also provided with the capability to deliver axial blows to the fish to facilitate retrieval.

Jars capable of inflicting axial blows contain a sliding joint which allows a relative axial movement between an inner mandrel and an outer housing without necessarily allowing relative rotational movement therebetween. The mandrel typically has a hammer formed thereon, while the housing includes an anvil positioned adjacent to the mandrel hammer. Thus, by sliding the hammer and anvil together at high velocity, a substantial jarring force may be imparted to the stuck object, which is often sufficient to jar the object free.

Some conventional jars employ a collet as a triggering mechanism. The collet is provided with one or more radially projecting flanges or teeth which engage a mating set of projections or channels in the mandrel. The engagement of the collet teeth and the mandrel teeth or channels restrains the longitudinal movement of the mandrel until some desired trigger point is reached. The trigger point frequently corresponds to the vertical alignment between the collet teeth and a channel or set of channels in the tool housing. At this point, the collet is no longer compressed radially inwardly and can expand rapidly in diameter to release the mandrel. The surfaces of the collet teeth and the channel or channels of the housing engaged just prior to triggering may be subject to significant point loading, which can lead to rapid wear and the need for frequent repair. Furthermore, some conventional designs do not provide structure to prevent the premature expansion of the collet, which can otherwise lead to a sticking of the mandrel or a premature triggering. Premature triggering can lead to diminished overpull and application of less than desired axial force.

Many well operations are presently carried out with strings that utilize electrical power. Such tool strings are often suspended from conducting and non-conducting cables, such as wirelines and slicklines. In some wireline and slickline operations, it may be desirable to deploy a jar with tool string. If the jar is incapable of transmitting electrical power and signals, it must be positioned in the bottom hole assembly ("BHA") below the electrically powered components of the BHA. However, this may not be the optimum position for the jar in view of the operation to be performed.

The present invention is directed to overcoming or reducing the effects of one or more of the foregoing disadvantages.

SUMMARY OF THE INVENTION

In accordance with one aspect of the present invention, a downhole tool is provided that includes a housing and a mandrel telescopically positioned in the housing with an electrically insulating coating. The mandrel and the housing define a pressure compensated substantially sealed chamber containing a volume of a non-conducting fluid. A conductor member is insulatingly coupled to the housing. A portion of the conductor member is electrically insulated from an ambient fluid by the non-conducting fluid. A first biasing member is provided for maintaining a conducting pathway between the mandrel and the conductor member, engaging the mandrel, and a sleeve positioned around and being axially moveable relative to the collet, the sleeve having a reduced inner diameter portion at which the collet selectively expands radially to disengage the mandrel.

In accordance with another aspect one aspect of the present invention, a downhole tool is provided that includes a housing with an external vent and a mandrel telescopically positioned in the housing. The mandrel has an electrically insulating coating. The mandrel and the housing define a chamber in fluid communication with the vent. The mandrel has a first pressure area in fluid communication with the chamber and a second pressure area of substantially equal area to the first pressure area whereby ambient fluid pressure acting on the first and second pressure areas hydrostatically balances the mandrel. A conductor member is insulatingly coupled to the housing and is electrically insulated from the ambient fluid. A first biasing member is provided for maintaining a conducting pathway between the mandrel and the conductor member.

In accordance with another aspect of the present invention, a downhole tool is provided that includes a housing and a mandrel telescopically positioned in the housing. The mandrel and the housing define a pressure compensated substantially sealed chamber containing a volume of a non-conducting fluid. A conductor member is positioned in the housing for providing an electrically conducting pathway. The conductor member has a first segment and a second segment. The first segment is moveable with the mandrel and relative to the second segment. A portion of the conductor member is electrically insulated from an ambient fluid by the non-conducting fluid. A first biasing member is provided for maintaining a conducting pathway between the first segment and the second segment.

In accordance with another aspect of the present invention, a downhole tool is provided that includes a housing with an external vent and a mandrel telescopically positioned in the housing. The mandrel and the housing define a chamber in fluid communication with the vent. The mandrel has a first pressure area in fluid communication with the chamber and a second pressure area of substantially equal area to the first pressure area whereby ambient fluid pressure acting on the first and second pressure areas hydrostatically balances the mandrel. A conductor member is insulatingly positioned in the housing for providing an electrically conducting pathway. The conductor member has a first segment and a second segment. The first segment is moveable with the mandrel and relative to the second segment. A first biasing member is provided for maintaining a conducting pathway between the first segment and the second segment.

In accordance with another aspect of the present invention, a downhole tool is provided that includes a housing and a mandrel telescopically positioned in the housing. The mandrel and the housing define a pressure compensated substantially sealed chamber containing a volume of a non-conducting fluid. A conductor cable is positioned in the housing for providing an electrically conducting pathway through the housing. The conductor cable is sealed from the ambient fluid pressure and has a sufficient length whereby the conductor cable is operable to elongate when the mandrel and the housing are telescopically moved away from one another.

In accordance with another aspect of the present invention, a downhole tool is provided that includes a housing with an external vent and a mandrel telescopically positioned in the housing. The mandrel and the housing define a chamber in fluid communication with the vent. The mandrel has a first pressure area in fluid communication with the chamber and a second pressure area of substantially equal area to the first pressure area whereby ambient fluid pressure acting on the first and second pressure areas hydrostatically balances the mandrel. A conductor cable is positioned in the housing for providing an electrically conducting pathway through the housing. The conductor cable is sealed from the ambient fluid pressure and has a sufficient length whereby the conductor cable is operable to elongate when the mandrel and the housing are telescopically moved away from one another.

BRIEF DESCRIPTION OF THE DRAWINGS

The foregoing and other advantages of the invention will become apparent upon reading the following detailed description and upon reference to the drawings in which:

FIGS. 1A–1F illustrate successive portions, in quarter section, of an exemplary embodiment of a downhole tool in its neutral position in accordance with the present invention;

FIG. 2 is a sectional view of FIG. 1B taken at section 2—2 in accordance with the present invention;

FIG. 3 is a pictorial view of an exemplary collet of the downhole tool of FIGS. 1A–1F in accordance with the present invention;

FIG. 4 is a pictorial view of an exemplary biasing member of the downhole tool of FIGS. 1A–1F in accordance with the present invention;

FIG. 5 is a magnified view of a portion of FIG. 1E in accordance with the present invention;

FIGS. 11A–11D illustrate four portions, in full section, of an alternate exemplary embodiment of the downhole tool in accordance with the present invention.

DETAILED DESCRIPTION OF SPECIFIC EMBODIMENTS

Figure 1A:
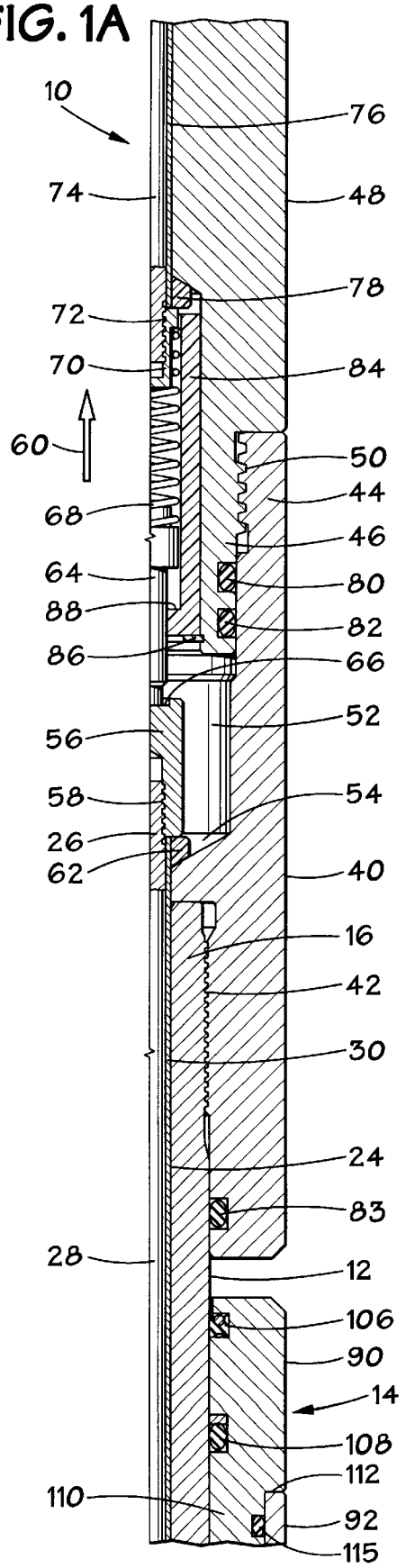

In the drawings described below, reference numerals are generally repeated where identical elements appear in more than one figure. Turning now to the drawings, and in particular to FIGS. 1A–1F, inclusive, there is shown an exemplary embodiment of a downhole tool 10 which is of substantial length necessitating that it be shown in seven longitudinally broken quarter sectional views, vis-a-vis FIGS. 1A, 1B, 1C, 1D, 1E and 1F. The downhole tool 10 may be inserted into a well borehole (not shown) via a pipe, tubing or cable string as desired. In the present illustration, the downhole tool is depicted as ajar. FIGS. 1A–1F show the downhole tool 10 in a neutral or unfired condition. The downhole tool 10 generally consists of an inner tubular mandrel 12 that is telescopically supported inside an outer tubular housing 14. Both the mandrel 12 and the housing 14 consist of a plurality of tubular segments joined together, preferably by threaded interconnections. The mandrel 12 consists of an upper segment 16 and a lower segment 18 that is threadedly connected to the upper segment 16 at 20. The mandrel 12 is provided with an internal longitudinal bore 24 that extends throughout the entire length thereof. An elongated conductor member or rod 26 is provided that consists of a segment 28 that is positioned in the bore 24 and electrically insulated from the mandrel 12 and the housing 14 by an insulating sleeve 30, a segment 32 positioned in the housing 14 (see FIG. 1E) and threadedly engaged to the segment 28 at 34, and a segment 36 telescopically arranged with the segment 32. An electrical pathway between the telescoping segments 32 and 36 is maintained by a biasing member 38. As described more filly below, the conductor member 26 is designed to transmit electrical power and signals through the downhole tool 10 without exposure to well annulus fluids and while the downhole tool 10 undergoes telescopic movements.

Turning again to FIG. 1A, the upper end of the upper tubular section 16 of the mandrel 12 is threadedly connected to a connector sub 40 at 42. The connector sub 40 is provided with a female box connection 44 that is designed to threadedly receive the male end 46 of another downhole tool or fitting 48 at 50. The tool 48 is illustrated as a weight bar, but may be virtually any type of downhole tool. The upper end of the conductor member 26 projects slightly out of the bore 24 and into a cylindrical space 52 in the connector sub 40 that defines an upwardly facing annular shoulder 54. The upper end of the conductor member 26 is threadedly engaged to a contact socket 56 at 58. Axial force applied to the mandrel 12 in the uphole direction indicated by the arrow 60 via the tool 48 and the connector sub 40 is transmitted to the conductor member 26 by way of the annular shoulder 54 acting upon the contact socket 56. In this way, the segments 28 and 32 of the conductor member 26 translate upwards with axial movement of the mandrel 12. The contact socket 56 is electrically insulated from the connector sub 40 by an insulating ring 62 composed of Teflon®, polyurethane or some other suitable insulating material.

An electrical pathway from the contact socket 56 to the tool 48 is provided by a contact plunger 64 that is seated at its lower end in a shallow bore 66 in the contact socket 56 and is compliantly engaged at its upper end by a spring 68. The spring 68 is restrained at its upper end by a contact nut 70 that has a internal bore and a set of internal threads 72 to threadedly receive the lower end of a conductor member 74. The conductor member 74 includes an external insulating jacket 76 and an insulating ring 78 to electrically isolate the conductor member 74 from the tool 48. When the male end 46 of the tool 48 and the connector sub 40 are threaded together, the contact plunger 64 and the spring 68 provide a compliant electrical contact with the contact socket 56.

The joint between the connector sub 40 and the male member 46 is sealed against fluid passage by a pair of longitudinally spaced O-rings 80 and 82. The joint between the connector sub 40 and the mandrel 12 is sealed by an O-ring 83.

The contact plunger 64 and the spring 68 are insulated from the male end 46 of the tool 48 by a cylindrical insulating shell 84 that is seated at its lower end on a snap ring 86 that is coupled to the male end 46. The internal space of the insulator sleeve 84 defines an upwardly facing annular shoulder 88 that acts as a lower limit of axial movement of the plunger 64.

Referring again to FIGS. 1A–1F, the housing 14 consists of an upper tubular section 90, an intermediate tubular section 92, an intermediate tubular section 94, an intermediate tubular section 96, an intermediate tubular section 98, an intermediate tubular section 100, an intermediate tubular section 102 and a bottom tubular section 104. The upper tubular section 90 is threadedly secured to the intermediate tubular section 92 at 105. It is desirable to prevent mud or other material in the well from contaminating fluids in the downhole tool 10, and to prevent loss of tool operating fluid into the well. Accordingly, the upper tubular section 90 includes a seal arrangement that consists of a loaded lip seal 106 and an O-ring 108 positioned below the loaded lip seal 106. The upper tubular section 90 includes a reduced diameter portion 110 that defines a downwardly facing annular surface 112 against which the upper end of the tubular section 92 is abutted and a downwardly facing annular anvil surface 114. The joint between the upper tubular section 90 and the intermediate tubular section 92 is sealed against fluid passage by an O-ring 115. The upper section 16 of the mandrel 12 includes an expanded diameter portion 116 that defines an upwardly facing annular hammer surface 118. As described more fully below, when the mandrel 12 is moved axially upward relative to the housing 14 at high velocity, the hammer surface 118 is impacted into the downwardly facing anvil surface 114 to provide a substantial upward axial jarring force.

A fluid chamber 120 is generally defined by the open internal spaces between the inner wall of the housing 14 and the outer wall of the mandrel 12. The chamber 120 extends generally longitudinally downward through a portion of the housing 14 and is sealed at its lower end by a pressure compensating piston 122 (See FIG. 1D). The interior of the housing 14 below the pressure compensating piston 122 is vented to the well annulus by one or more ports 124 located in the intermediate tubular section 100. Lubricating fluid is enclosed within the chamber 120. The lubricating fluid may be hydraulic fluid, light oil or the like.

Referring now also to FIG. 2, which is a sectional view of FIG. 1A taken at section 2—2, the interior surface of the intermediate tubular section 92 is provided with a plurality of circumferentially spaced flats 128. The flats 128 are configured to slidedly mate with a matching set of external flats 130 fabricated on the exterior of the expanded diameter portion 116 of the mandrel 12. The sliding interaction of the flats 128 and 130 provide for relative sliding movement of the mandrel 12 and the housing 14 without relative rotational movement therebetween. To enable the lubricating fluid of the downhole tool 10 to readily flow past the expanded diameter portion 116, a plurality of external slots 132 are fabricated in one or more of the flats 130 to act as flow passages for the lubricating fluid.

Figure 1B:
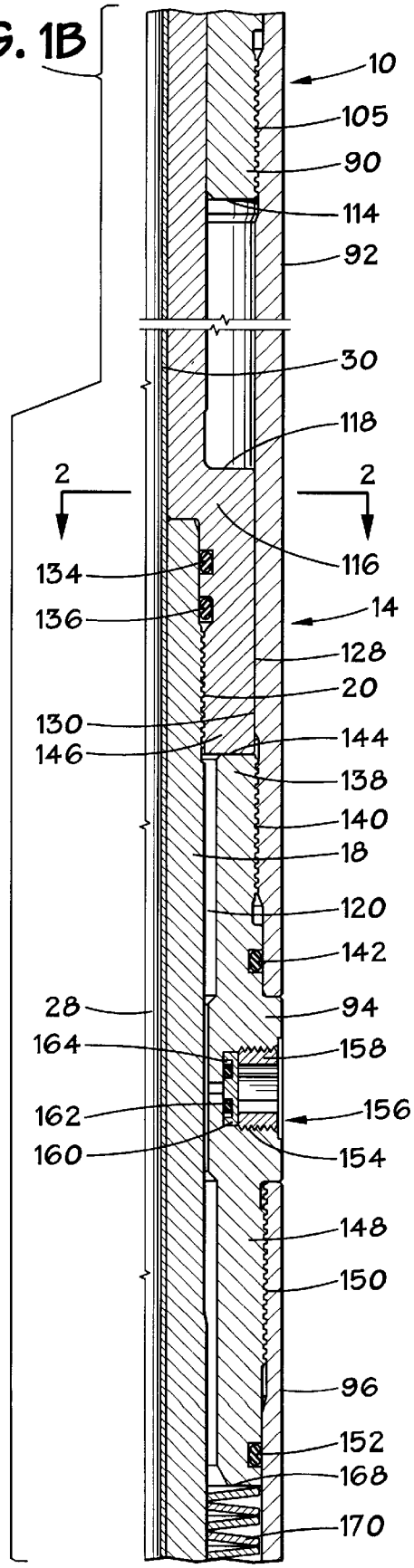

Referring now to FIG. 1B, the threaded joint at 20 between the mandrel segments 16 and 18 is sealed by O-rings 134 and 136. The intermediate tubular section 94 of the housing 14 is provided with an upper reduced diameter portion 138 that is threadedly engaged to the lower end of the intermediate section 92 at 140. The joint between the intermediate section 92 and the upper reduced diameter portion 138 is sealed against fluid passage by an O-ring 142. The upper reduced diameter portion 138 defines an upwardly facing annular surface 144 against which the lower end 146 of the expanded diameter portion 116 of the mandrel 12 may seat. The annular surface 144 represents the lower limit of downward axial movement of the mandrel 12 relative to the housing 14. The intermediate section 94 includes a substantially identical lower reduced diameter portion 148 that is threadedly engaged to the upper end of the intermediate section 96 at 150. The joint between the lower expanded reduced diameter portion 148 and the intermediate tubular section 96 is sealed against fluid passage by an O-ring 152.

The intermediate section 94 is provided with one or more fill ports 154 which are capped by fluid plugs 156. Each of the fluid plugs 156 consists of a hex nut 158 that compresses a seal disk 160 that is provided with an O-ring 162 and a seal ring 164. The seal ring 164 is located at the outer diameter of the O-ring 162. The fill ports 154 are designed to permit the filling of the fluid chamber 120 with lubricating fluid.

The wall thickness of the intermediate section 94 in the vicinity of the fill ports 154 must be thick enough to accommodate the profiles of the plugs 156 while providing sufficient material to withstand the high pressures associated with the operation of the downhole tool 10. This entails a relatively tight tolerance between the inner diameter of the intermediate section 94 and the segment 18 of the mandrel 12, and would otherwise constitute a significant restriction to the passage of hydraulic fluid past the mandrel segment 18. To alleviate this potential flow restriction, the intermediate section 18 of the mandrel 12 may be provided with an oval cross-section.

Figure 1C:
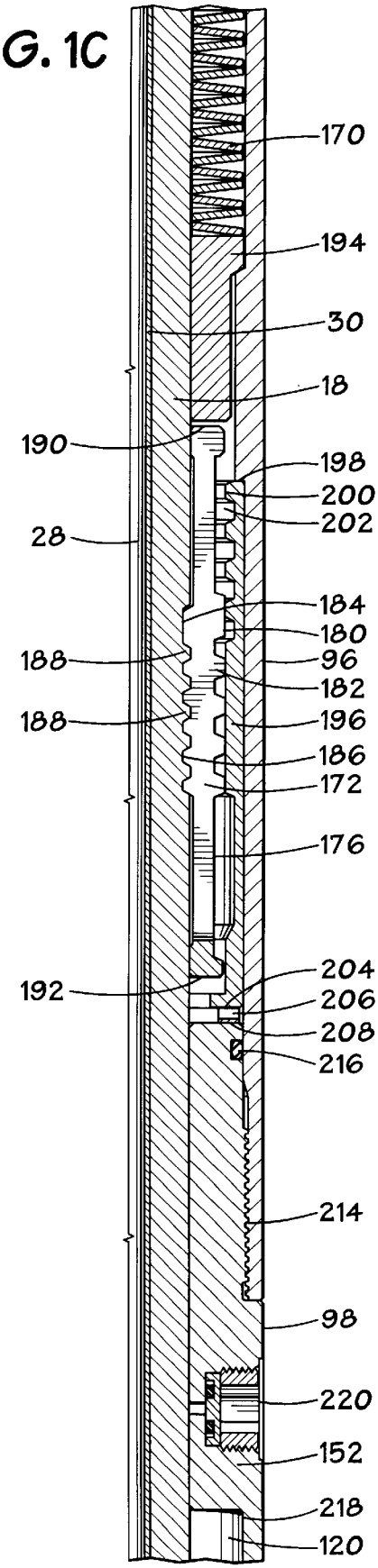

Still referring to FIGS. 1B and 1C, the reduced diameter portion 148 of the tubular section 94 defines a downwardly facing annular surface 168 against which the upper end of a biasing member 170 bears. The biasing member 170 advantageously consists of a stack of bellville springs, although other types of spring arrangements may be possible, such as one or more coil springs. As described more fully below, the biasing member 170 is designed to resist upward axial movement of the mandrel 12 and to return the mandrel 12 to the position shown in FIG. 1B after an upward jarring movement of the downhole tool 10. The biasing member 170 also provides the downhole tool 10 with a preload that enables the operator to apply an upward axial force on the mandrel 12 without necessarily commencing a triggering cycle. For example, the biasing member 170 may be configured to apply a 1000 lb. downward force on the mandrel 12 with the downhole tool 10 in the position shown in FIGS. 1A–1F. So long as the upward axial force applied to the mandrel 12 does not exceed this preload, the downhole tool 10 will not begin a triggering cycle. In this way, the operator is provided with flexibility in pulling on the components coupled to the downhole tool 10. Optionally, a floating hydraulic piston may be used as or in conjunction with the biasing member 170.

It should be appreciated that the biasing member 170 functions to retard the upward movement of the mandrel 12 to allow a build-up of potential energy in the working string when a tensile load is placed on the mandrel 12 from the surface. This transmission of an upward acting force on the mandrel 12 to the biasing member 170 requires a mechanical linkage between the mandrel 12 and the biasing member 170. This mechanical linkage is provided by a generally tubular collet 172 that is positioned within the tubular section 96. The mandrel 12, and more specifically the segment 18 thereof extends through the collet 172.

The detailed structure of the collet 172 may be understood by referring now also to FIG. 3, which is a pictorial view of the collet removed from the downhole tool 10. The collet 172 has a plurality of longitudinally extending and circumferentially spaced slots 174 that divide the central portion of the collet 172 into a plurality of longitudinally extending and circumferentially spaced segments 176. During the operation of the downhole tool 10, the segments 176 will be subjected to bending stresses. Accordingly, it is desirable to round the ends 178 of the slots 174 to avoid creating stress risers. Each of the longitudinal segments 176 has an outwardly projecting primary member or flange 180 and a plurality of outwardly projecting secondary members or flanges 182. The primary flange 180 is located above the secondary flanges 182 and has a greater width than the secondary flanges 182. As best seen in FIG. 1C, the internal surface of each segment 176 is provided with a primary inwardly facing member or flange 184 and a plurality of secondary inwardly facing members or flanges 186. The exterior surface of the section 18 of the mandrel 12 is provided with a plurality of external grooves or flanges 188 which are configured to mesh with the primary and secondary inwardly facing flanges 184 and 186 of the collet 172.

The upper and lower ends of the collet 172 terminate in respective annular flat surfaces 190 and 192. A compression ring 194 is positioned between the upper annular surface 190 and the lower end of the biasing member 170. So long as the inwardly facing flanges 184 and 186 of the collet 172 are retained in physical engagement with the flanges 188 of the mandrel segment 18, axial force applied to the mandrel 12 will be transmitted through the collet 172 to the compression ring 194 and thus the biasing member 170.

A tubular sleeve 196 is positioned around the collet 172 and inside the intermediate tubular section 96. The sleeve 196 is positioned in an expanded diameter section of the intermediate section 96 that defines a downwardly facing annular surface 198 which defines the upward limit of axial movement of the sleeve 196. The upper end of the sleeve 196 is provided with a reduced diameter portion consisting of a plurality of inwardly projecting flanges 200 which are separated by a corresponding plurality of grooves 202 which are sized and configured to receive the outwardly projecting secondary flanges 182 of the collet 172 when the tool 10 is triggered. If an axial force high enough to compress the biasing member 172 is applied to the mandrel 12, the collet 172 moves upward axially. At the moment when the outwardly projecting secondary flanges 182 are in alignment with the grooves 202 of the sleeve 196, the collet segments 176 expand radially outwardly until the flanges 182 seat in the grooves 202. At this point, the mandrel 12 is released from the retarding action of the collet 172 and allowed to rapidly accelerate upwards, propelling the hammer surface 118 into the anvil surface 114 (See FIG. 1B).

The lower end of the sleeve 196 terminates in a downwardly facing annular surface 204, which is seated on a biasing member 206. The biasing member 206 is, in turn, seated on an upwardly facing annular surface 208 of the intermediate tubular section 98. The biasing member 206 may be wave spring, a coil spring or other type of biasing member. In an exemplary embodiment, the biasing member 206 is a wave spring. FIG. 4 depicts a pictorial view of an exemplary wave spring biasing member 206. As shown in FIG. 4, the biasing member 206 includes a plurality of peaks 210 which are in physical contact with the lower end of the sleeve 196 and a plurality of troughs 212 that are normally in contact with the upwardly facing annular surface 208. The biasing member 206 is designed to apply an upward bias to the sleeve 196. During a triggering cycle, the biasing member 206 enables the sleeve 196 to translate downward a small distance to facilitate triggering. This function will be described in more detail below.

Referring again to FIG. 1C, the lower end of the intermediate tubular section 96 is threadedly engaged to the upper end of the intermediate tubular section 98 at 214. That joint is sealed against fluid passage by an O-ring 216.

Figure 1D:
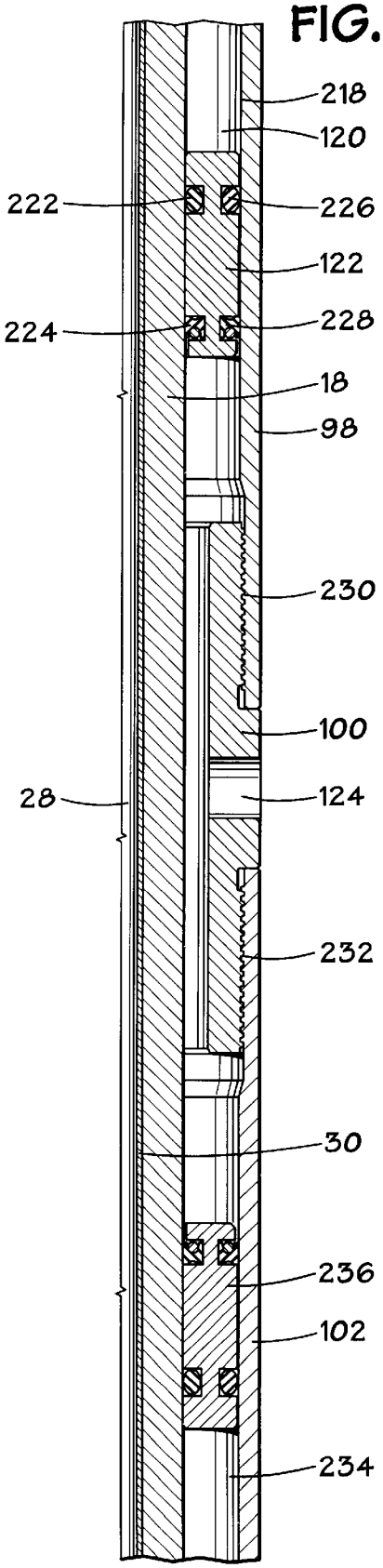

Referring now to FIGS. 1C and 1D, the lower end of the intermediate tubular section 98 includes an expanded diameter region 218 that provides an annular space for the sliding movement of the compensating piston 122. A fill port 220 of the type described above may be provided in the section 98 above the region 218. The compensating piston 122 is journalled about the mandrel segment 18 and is designed to ensure that the pressure of the fluid in the chamber 120 is substantially equal to the annulus pressure that is supplied via the vent 124. The compensating piston 122 is sealed internally, that is, against the surface of the mandrel segment 18 by an O-ring 222 and a longitudinally spaced loaded lip seal 224. The piston 122 is sealed externally, that is, against the interior surface of the housing section 98 by an O-ring 226 and an longitudinally spaced lip seal 228 that are substantially identical to the O-ring 222 and the lip seal 224. The lower end of the intermediate tubular section 98 is threadedly engaged to the upper end of the intermediate tubular section 100 at 230.

The lower end of the intermediate section 100 is threadedly engaged to the upper end of the intermediate section 102 at 232. An annular chamber 234 is defined by the intermediate section 102, the intermediate section 104 and the mandrel section 18. The fluid chamber 234 is pressure compensated by a pressure compensating piston 236 that is journalled around the mandrel section 18 and may be substantially identical to the compensating piston 122, albeit in a flip-flopped orientation. The pressure compensating piston 236 is designed to ensure that the pressure of fluid inside the chamber 234 is substantially equal to the annulus pressure supplied via the vent 124.

The lower end of the downhole tool 10 will now be described. Referring now to FIGS. 1E and 1F, the lower end of the mandrel section 18 includes an increased internal diameter section 238 which defines a downwardly facing annular shoulder 240. An insulator ring 242 is pressed at its upper end against the annular shoulder 240 and is seated at its lower end on the upper end of the conductor member segment 34. The lower end of the insulating jacket 30 terminates in an annular cut-out formed in the insulator ring 242. Fluid leakage past the insulator ring 242 is restricted by a pair of external O-rings 244 and 246 and an internal O-ring 248. The conductor member segments 28 and 32 are threadedly engaged at 250. Optionally, the segments 28 and 32 may be joined by welding or other fastening methods or may be combined into a single integral member as desired. The conductor member segment 32 is electrically insulated from the reduced diameter portion 238 of the mandrel segment 18 by an insulating bushing 252. The bushing 252 includes a longitudinal slot 254 that is designed to permit a dielectric fluid in the chamber 234 to flow past the lower end of the bushing 252 and through a port 256 in the conductor member segment 32. The lower end of the insulator bushing 252 is supported by a snap ring 258 that is coupled to the lower end of the reduced diameter portion 238. The port 256 is provided to ensure that the conductor member segment 36 is exposed to the non-conducting fluid.

As noted above, the segments 36 and 32 are arranged telescopically so that they may slide axially relative to one another. In the illustrated embodiment, the segments 32 and 36 are cylindrical members wherein the segment 36 is telescopically arranged inside of the segment 32. However, the skilled artisan will appreciate that other arrangements are possible. For example, the segment 36 could be provided with a larger internal diameter and the segment 32 provided with a smaller internal diameter and telescopically arranged inside of the segment 36. Furthermore, the segments 32 and 36 need not constitute completely cylindrical members. For example, one or the other may be an arcuate member that is less than fully cylindrical. The important feature is that there is sliding contact between the two segments 36 and 32.

To ensure that an electrical pathway is continuously maintained between the segments 32 and 36, the biasing member 38 is provided. The biasing member 38 is advantageously a compliant member composed of an electrically conducting material. A variety of arrangements are envisioned. An illustrative embodiment may be understood by referring now also to FIG. 5, which is a magnified view of the portion of FIG. 1E circumscribed by the dashed oval 260. In the illustrated embodiment, the biasing member 38 has a generally C-cross-section and an unbiased width that is slightly slarger than the width of an annular slot 262 formed in the internal diameter of the conductor member segment 32. In this way, when the biasing member 38 is positioned in the slot 262 and the segments 36 and 32 are mated together, the biasing member 38 will be compressed into the slot 262 and the surfaces of the biasing member 38 will therefore be biased against the various surfaces of the slot 262 and the segment 36. In this way, an electrical pathway is continuously maintained between the segment 36 and the segment 32.

The chamber 234 is advantageously filled with a non-conducting or dielectric fluid. The purpose of the fluid in the chamber 234 is to prevent electrical shorting that might otherwise occur if the chamber 234 is exposed to ambient fluids, such as drilling mud, fracturing fluids or various other types of fluids that may be present in the well annulus. A variety of non-conducting liquids may be used, such as, for example, silicone oils, dimethyl silicone, transformer dielectric liquid, isopropylbiphenyl capacitor oil or the like. If high downhole temperatures are anticipated, care should be taken to ensure the liquid selected will have a high enough flash point. The fluid may be introduced into the chamber 234 via a fluid port 264 in the housing section 102. The port 264 may be substantially identical to the port 154 described above in conjunction with FIG. 1B. Note that the combination of the dielectric fluid in the chamber 234, the insulating bushing 252, the insulator ring 242 and the insulating jacket 30 electrically isolate the conductor member segments 28, 32 and 36 from not only the otherwise electrically conducting housing 14 but also annulus fluids.

The lower end of the housing section 102 is threadedly engaged to the upper end of the bottom section 104 of the housing 14 at 266. This joint is sealed against fluid entry by an O-ring 268. The lower end of the conductor member segment 36 is threadedly engaged to an extension sleeve 270 at 272. Optionally, the segment 36 and the extension sleeve 270 may be otherwise fastened or formed integrally as a single component. The extension sleeve 270 is electrically insulated from the housing section 104 by an insulator ring 274, an insulating bushing 276 and an insulator ring 278. The insulator ring 278 is seated at its upper end against a downwardly facing annular shoulder 280 in the housing section 104. The extension sleeve 270 is threadedly engaged at its lower end to a contact nut 282 that may be substantially identical to the contact nut 70 depicted in FIG. 1A. The lower end of the contact nut 282 is seated on a contact spring 284 which, along with a contact plunger 286 as shown in FIG. 1F, may be substantially identical to the spring 68 and the contact plunger 64 depicted above and described in conjunction with FIG. 1A. The mating surfaces of the insulator ring 274 and the housing section 104 are sealed against fluid passage by a pair of O-rings 288 and 290 and the mating surfaces between the extension sleeve 270 and the insulator ring 274 are similarly sealed by a pair of O-rings 292 and 294.

As shown in FIG. 1F, the lower end of the housing section 104 includes a male end 296 that is threadedly engaged to the upper end of a downhole tool 298 at 300. The downhole tool 298 may be any of a variety of different types of components used in the downhole environment. The joint between the section 104 and the tool 298 is sealed against fluid passage by a pair of O-rings 302 and 304. The tool 298 is provided with a conductor member 306, a contact socket 308, and an insulator ring 310 that may be substantially identical to the conductor member 74, the contact socket 56 and the insulator ring 78 depicted in FIG. 1A and described above, albeit in a flip-flopped orientation. The cooperation of the contact plunger 286, the spring 284 and the contact socket 308 are such that when the male end 296 is threadedly engaged to the tool 298, a compliant electrical contact is established between the contact plunger 286 and the contact socket 308.

A variety of materials may be used to fabricate the various components of the downhole tool 10. Examples include mild and alloy steels, stainless steels or the like. Wear surfaces, such as the exterior of the mandrel 12, may be carbonized to provided a harder surface. For the various insulating structures, well known insulators may be used, such as, for example phenolic plastics, PEEK plastics, Teflon®, nylon, polyurethane or the like.

The jarring movement of the downhole tool 10 may be understood by referring to FIGS. 1A–1F inclusive, FIG. 3 and FIGS. 6A–8F inclusive. FIGS. 1A–1F show the downhole tool 10 in a neutral or unfired condition and FIGS. 6A–6F show the downhole tool 10 just after it has fired. In an unloaded condition, the downhole tool 10 is in a neutral position as depicted in FIGS. 1A–1F. To initiate a jarring movement of the downhole tool 10, an upwardly directed tensile load is applied to the mandrel 12 via the connector sub 40. The range of permissible magnitudes of tensile loads, and thus the imparted upward jarring force, is determined by a load-deflection curve for the particular configuration of the biasing member 172 shown in FIGS. 1B and 1C and by the strength of the string or wireline that is supporting the downhole tool 10. As force is applied to the mandrel 12, upward axial force is transmitted to the collet 172 through the engagement of the external flanges 188 of the mandrel 12 with the inwardly facing flanges 184 and 186 of the collet 172. The upper annular surface 190 of the collet 172 is then brought into engagement with the compression ring 194. The upward movement of the collet 172 and the mandrel 12 are retarded by the biasing member 170, allowing potential energy in the string to build. The collet 172 and the mandrel 12 continue upward in response to the applied force, again according to the load-deflection curve for the biasing member 172.

Figure 6A:
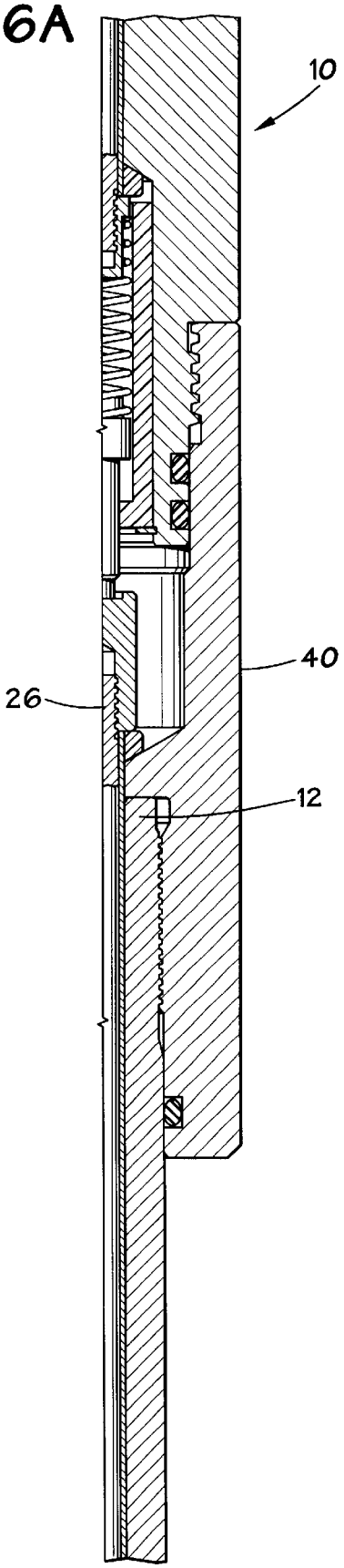
FIGS. 6A–6F illustrate successive portions, in quarter section, of the downhole tool of FIGS. 1A–1F showing the downhole tool in its fired position in accordance with the present invention.
Figure 6B:
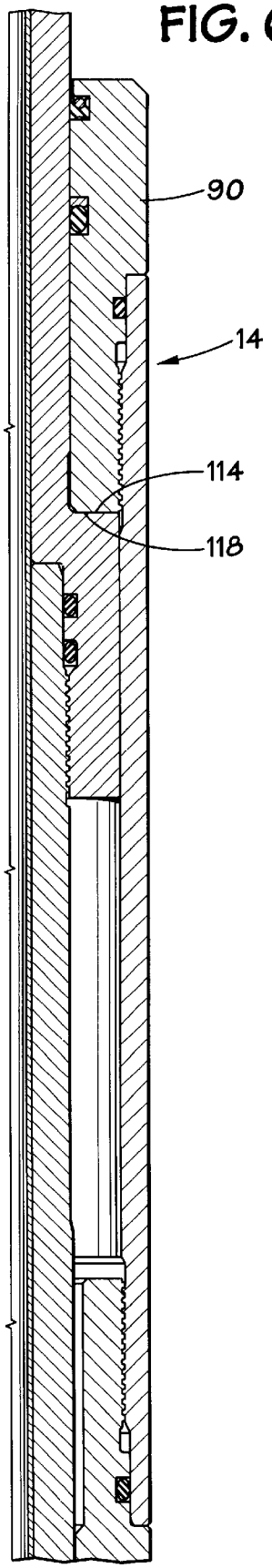

When the primary outwardly facing flanges 180 of the collet 172 just clear the upper end of the sleeve 196, the secondary outwardly projecting flanges 182 will be in substantial alignment with the channels 202 of the sleeve 196. At this point, the segments 176 may expand radially outwardly enough so that the outwardly projecting flanges 188 of the mandrel 12 clear the inwardly projecting flanges 184 and 186 of the collet 172, thereby allowing the mandrel 12 to translate upwards freely and rapidly relative to the housing 14. Without the strictures of the collet 172, the mandrel 12 accelerates upward rapidly bringing the hammer surface 118 of the mandrel 12 rapidly into contact with the anvil surface 114 of the tubular section 90 of the housing 14 as shown in FIG. 6B. If tension on the mandrel 12 is released, the biasing member 170 urges the piston mandrel 12 downward to the position shown in FIGS. 1A–1F. Note that throughout the telescoping movement of the mandrel 12 relative to the housing 14, electrical current may flow through the conductor member 26 via the telescopic movement of the conductor member segment 32 relative to the segment 36 (See FIGS. 6E and 6F) and the compliant physical contact provided by the biasing member 38.

The collet 172 is provided with a plurality of principal outwardly projecting flanges 166 that are wider than the channels 202 in the sleeve 196. This deliberate mismatch in dimensions is designed to prevent one or more of the secondary outwardly projecting flanges 182 from prematurely engaging and locking into one of the lower channels 202. Such a premature engagement between the outwardly projecting secondary flanges 182 and the channels 202 might prevent the additional axial movement of the mandrel 12 or result in a premature release of the mandrel 12 and thus insufficient application of upward jarring force.

Figure 6C:
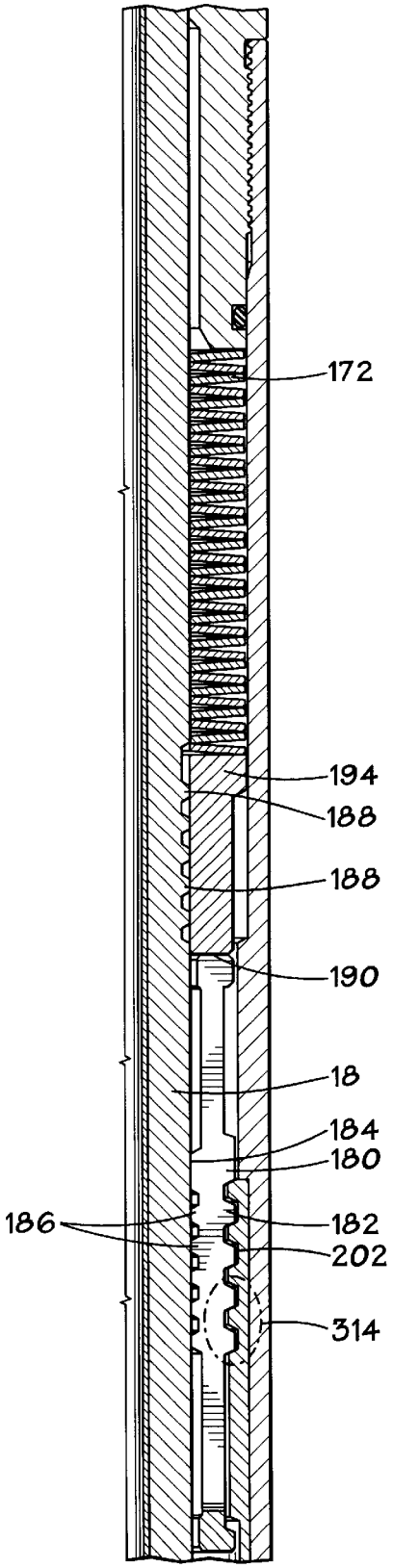
Figure 6D:
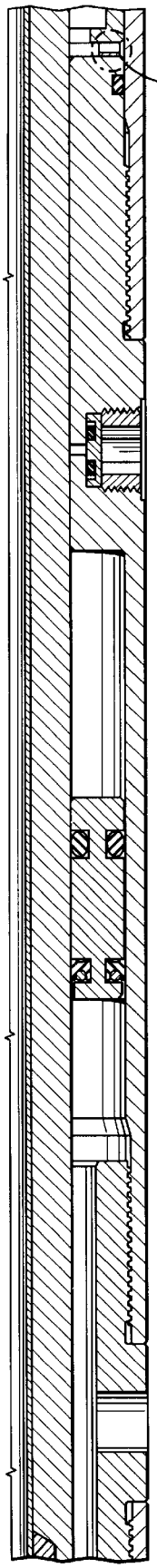
Figure 6E:
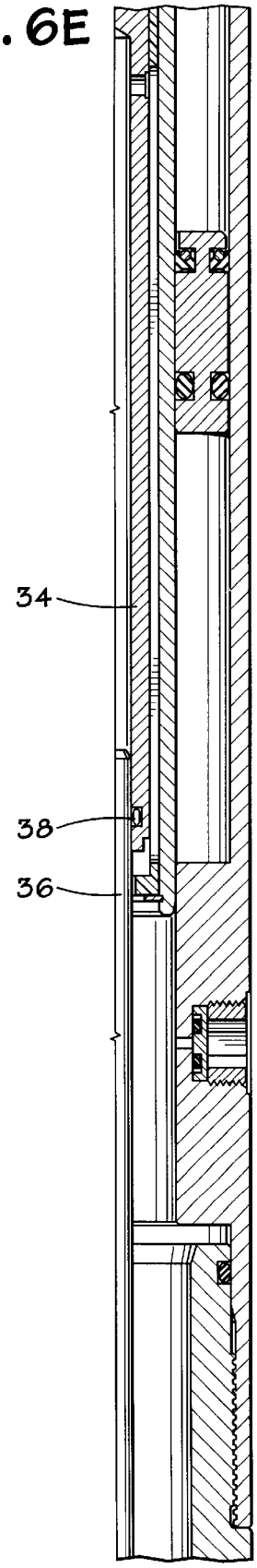
Figure 6F:
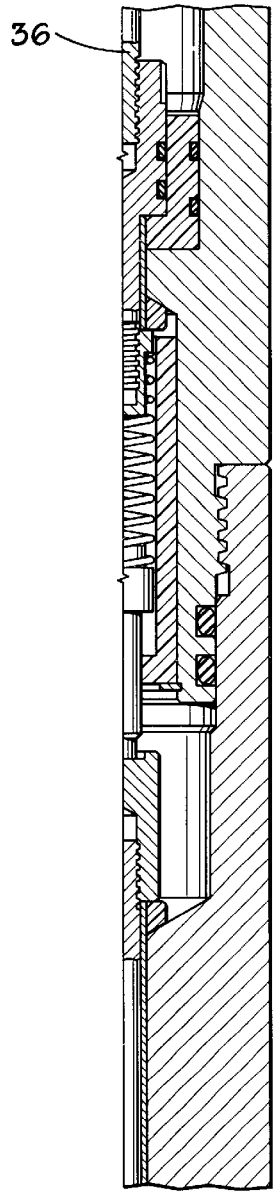
Figure 7:
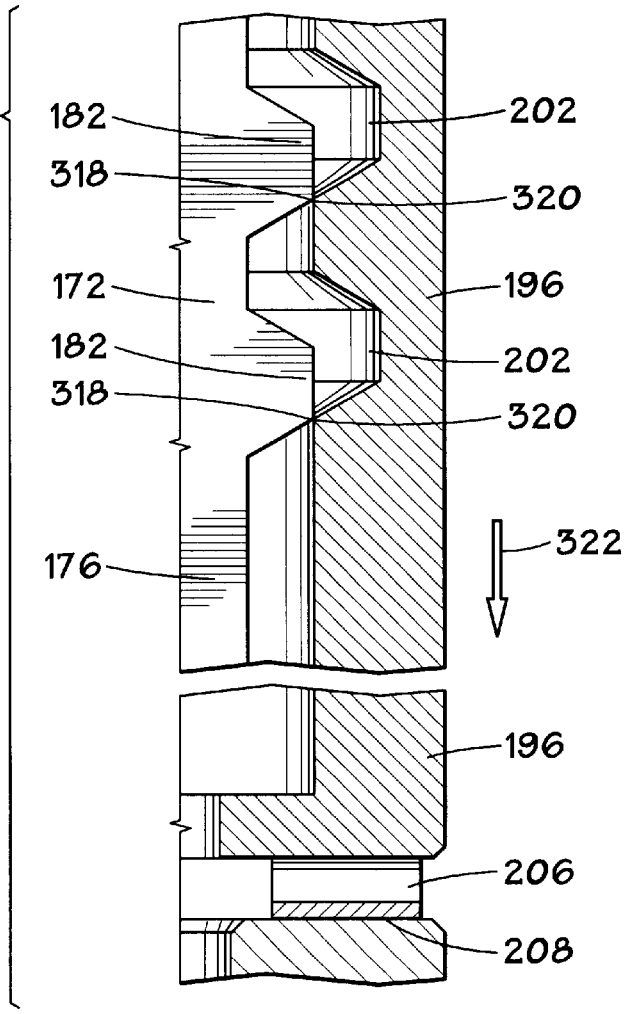
FIG. 7 is a magnified view of selected portions of FIGS. 6C and 6D in accordance with the present invention.

The function of the biasing member 206 depicted in FIG. 1C may be understood by referring now to FIG. 7, which is a magnified sectional view of the portions of FIGS. 6C and 6D circumscribed generally by the dashed ovals 314 and 316. The collet 172 is shown following substantial upward axial movement and just prior to triggering via radially outward movement of the secondary outwardly projecting flanges 182 into the channels 202 of the sleeve 196. When the collet 172 is moved to the position shown in FIG. 7, which is just prior to triggering, point loading occurs between the surfaces 318 of the outwardly projecting flanges 182 and the surfaces 320 of the sleeve 196. This point loading would last for some interval as the collet 172 moves upward and until the beveled surfaces of the flanges 172 begin to slide outwardly along the beveled surfaces of the channel 202. If the sleeve 196 is held stationary during this operation, the point loading between the surfaces 318 and 320 can result in significant wear of those corner surfaces. However, the biasing member 206 enables the point loading at the surfaces 318 and 320 to move the sleeve 196 axially downward in the direction of the arrow 322 and compress the biasing member 206. This downward axial movement of the sleeve 196 enables the flanges 182 to quickly slide into the channels 202 and minimize the duration of the point loading between the surfaces 318 and 320. In this way, the wear of the corner surfaces 318 and 320 is significantly reduced. This function may be served even with without the biasing member 206.

Figure 8A:
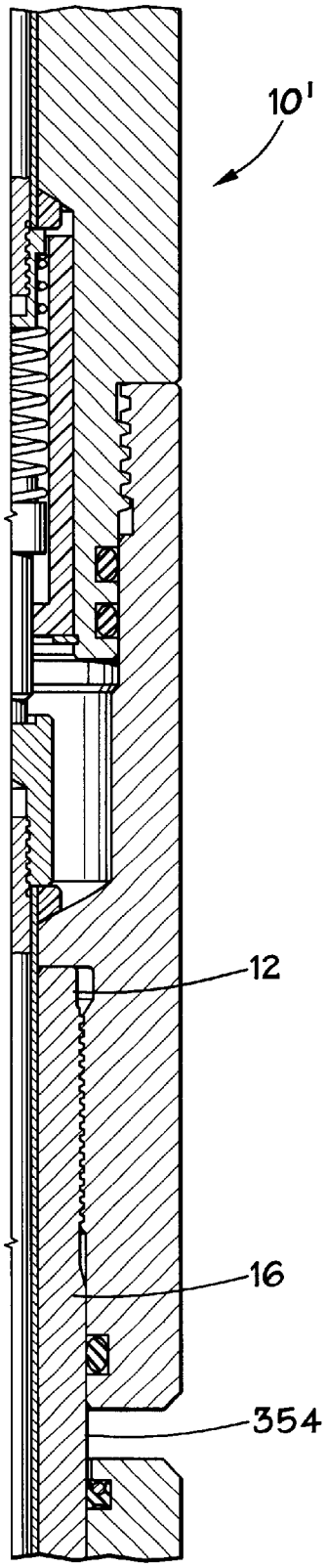
FIGS. 8A–8C illustrate three portions, in quarter section, of an alternate exemplary embodiment of the downhole tool in accordance with the present invention.
Figure 8B:
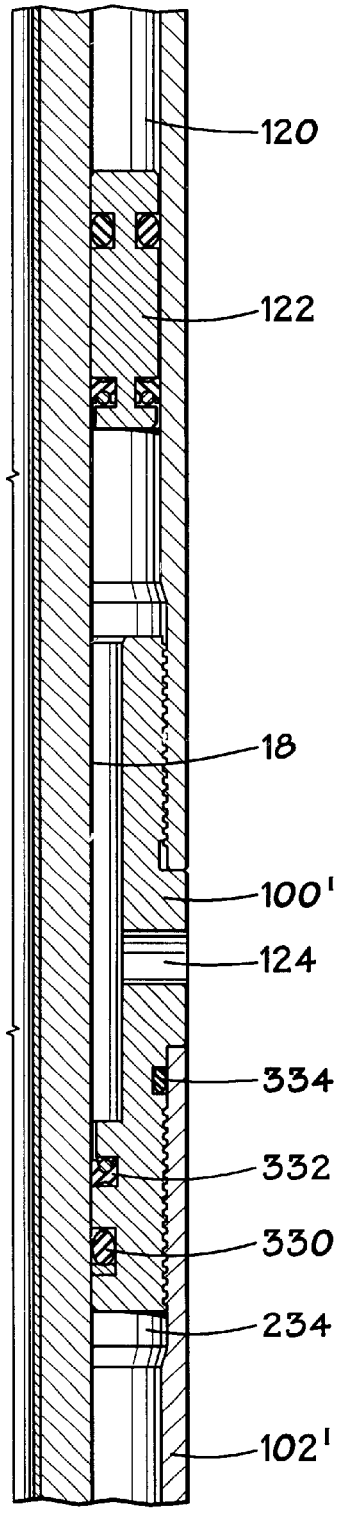
Figure 8C:
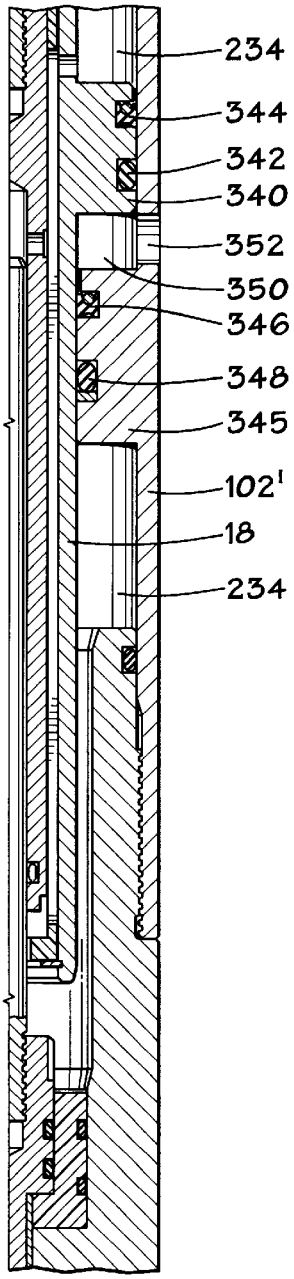

An alternate exemplary embodiment of the downhole tool, now designated 10', may be understood by referring now to FIGS. 8A, 8B and 8C. FIG. 8A is a quarter sectional view similar to FIG. 1A, FIG. 8B is a quarter sectional view similar to FIG. 1D and FIG. 8C is a quarter sectional view similar to FIG. 1E. This embodiment may be substantially identical to the embodiment illustrated above in FIGS. 1A–1F with a few notable exceptions. In this illustrative embodiment, the fluid chamber 120 is pressure compensated by the compensating piston 122 and annulus pressure through the vent 124 as generally described above. However, unlike the foregoing embodiment, the lower end of the intermediate housing section, now designated 100' and shown in FIG. 8B, is not in fluid communication with the fluid chamber 234. Rather, the interface between the lower end of the intermediate housing section 100' and the mandrel segment 18 is sealed by an O-ring 330 and a loaded lip seal 332. Furthermore, an O-ring 334 is provided to seal the threaded connection between the intermediate housing section 100' and the intermediate housing section 102' at 232. Referring now specifically to FIG. 8C, the mandrel segment 18 is provided with an expanded diameter section 340 that is slightly smaller than the internal diameter of the adjacent wall of the intermediate housing section 102'. This interface is sealed against fluid passage by an O-ring 342 and a loaded lip seal 344. The intermediate housing section 102' is provided with a reduced internal diameter portion 345. The interface between the portion 345 and the lower end of the mandrel segment 18 is sealed against the passage of annulus fluid by a loaded lip seal 346 and an O-ring 348. The expanded diameter section 340 and the portion 345 generally define a chamber 350 that is vented to the well annulus by a vent 352. The pressure area of the expanded diameter section 340 is selected to be the same as the pressure area of the mandrel segment 16 exposed to annulus pressure at 354 as shown in FIG. 8A. In this way, the tool 10' is hydrostatically balanced and the chamber 234 may be an atmospheric chamber filled with air or some other gas. This configuration thus eliminates the need for the dielectric fluid and the pressure compensating piston 236 depicted in FIG. 1D.

Figure 9:
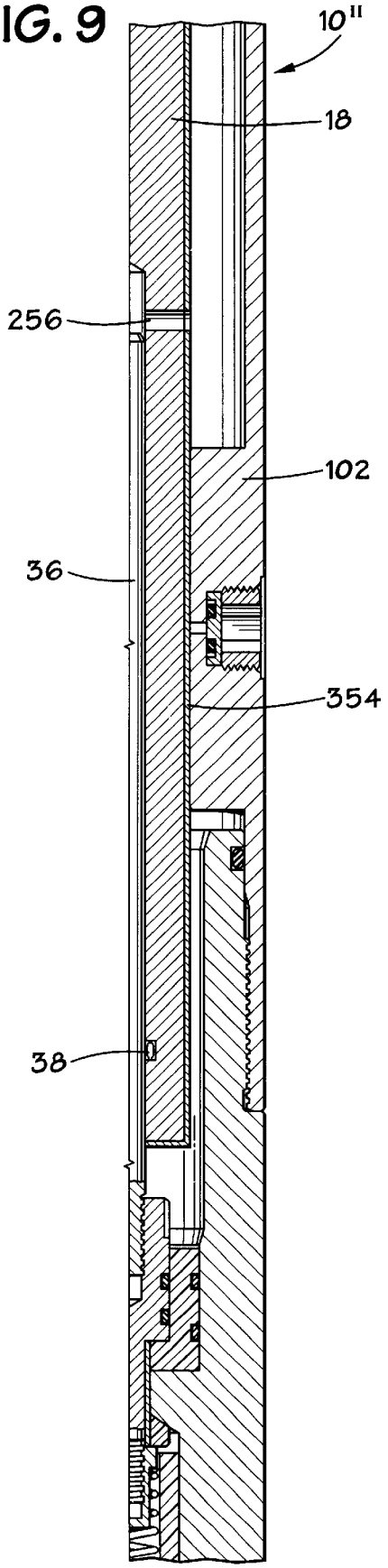
FIG. 9 illustrates a portion, in quarter section, of another alternate exemplary embodiment of the downhole tool in accordance with the present invention.

Another alternate exemplary embodiment of the tool now designated 10" may be understood by referring now to FIG. 9, which is a quarter sectional view like FIG. 1A. In the foregoing illustrative embodiments, a conductor member 26 is positioned inside and separately insulated from the mandrel 12. This configuration is necessary in order to electrically isolate the conducting conductor member 26 from the otherwise electrically conducting mandrel 12 and housing 14. However, the mandrel may serve as the longitudinal conducting member in the tool 10" with the attendant elimination of the separate conductor member 26 depicted in FIG. 1A. As shown in FIG. 9, the mandrel, now designated 12', may be coated with an electrically insulating coating 354 so that it is electrically insulated from the conducting surfaces of the housing 14. Comparing FIG. 9 with FIG. 1E, it is apparent that the embodiment illustrated in FIG. 9 eliminates the need for the separate conductor member segment 32, the insulating ring 242 and the insulator bushing 252. The same telescopic interaction with the conductor segment 36 remains. A variety of insulating coatings may be used, such as, for example, various well known ceramic materials such as aluminum oxide, may be used.

Figure 10:
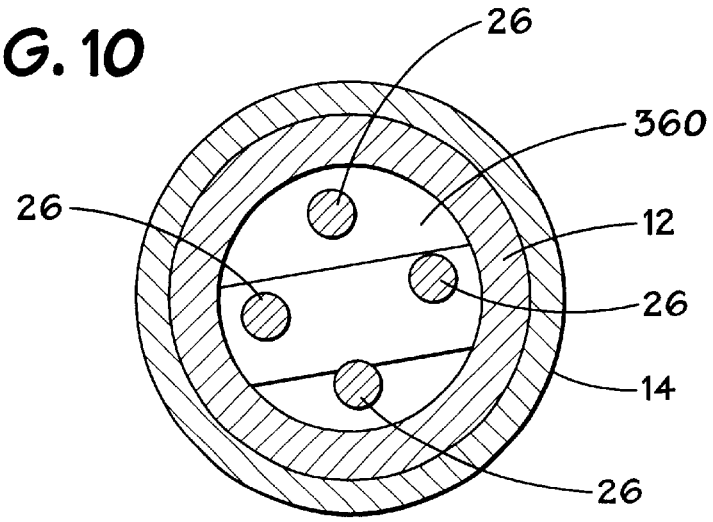
FIG. 10 is a cross-sectional view of another alternate exemplary embodiment of the downhole tool in accordance with the present invention.

It is envisioned that any of the foregoing exemplary embodiments of the downhole tool may be fitted with more than one conductor member 26. A schematic cross-sectional representation of this alternative is illustrated in FIG. 10. For example, several conductor members 26 may be run parallel through the housing 14 or the mandrel 12 as shown. The members 26 may be electrically isolated from each other by an insulating core 360. In this way multiple telescoping conducting pathways may be provided to transmit power, data, communications and other transmissions.

Figures 11A, 11B:
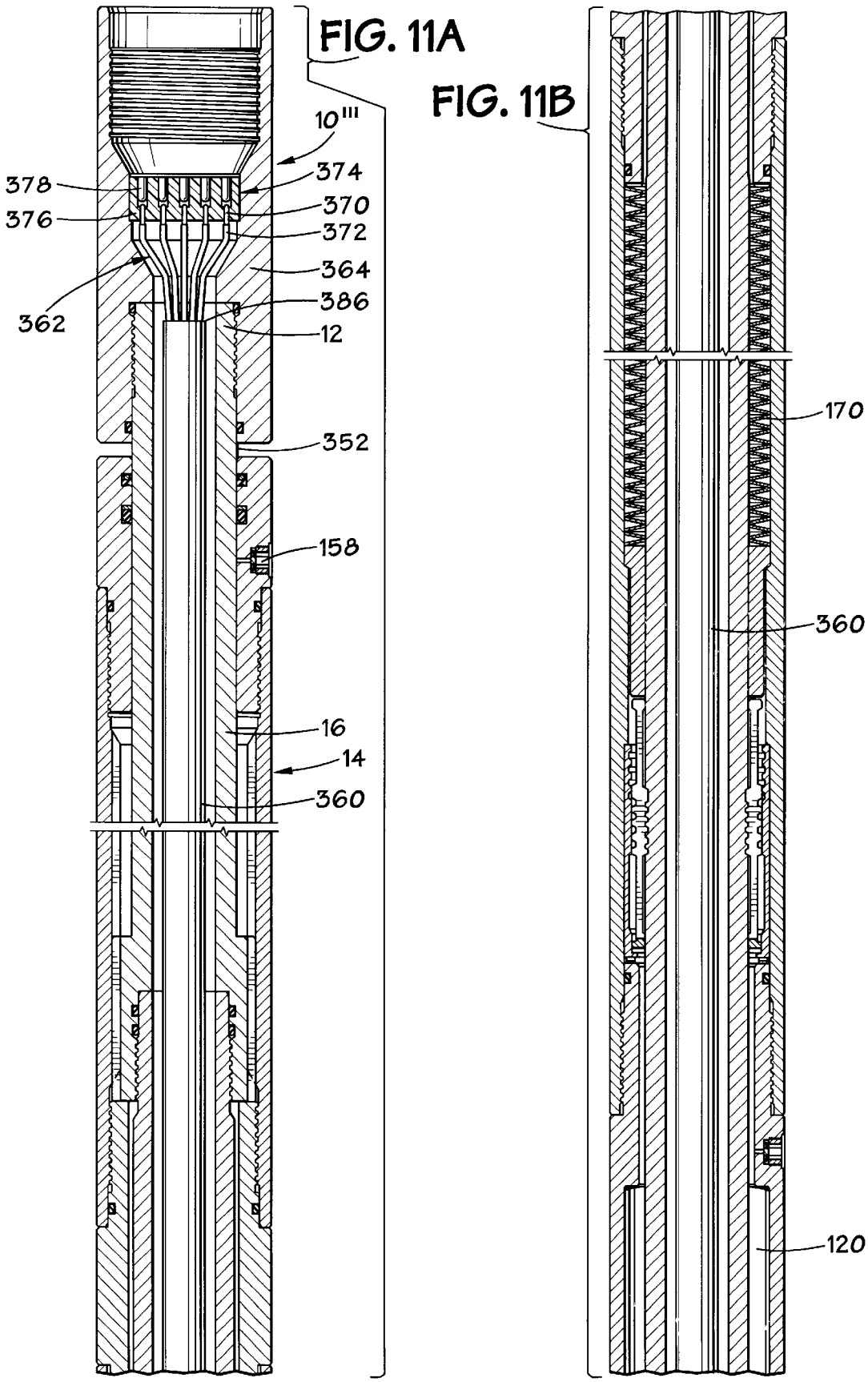

Another alternate exemplary embodiment of the downhole tool, now designated 10'''', may be understood by referring now to FIGS. 11A, 11B, 11C and 11D. FIGS. 11A–11D depict, respectively, successive full sectional views of the downhole tool 10'''' in a relaxed or unfired condition. This embodiment may be substantially identical to the embodiment illustrated above in FIGS. 8A, 8B and 8C with a few notable exceptions. In this illustrative embodiment, the conductor member 26 utilized in the other illustrated embodiments is supplanted by a conductor cable 360. A central portion of the conductor cable 360 is positioned inside the mandrel 12 while an upper end 364 thereof terminates in a female box connection 364 that is threadedly engaged the mandrel 12. A lower end 366 of the conductor cable 360 similarly terminates in a female box connection 368 that is threadedly engage to the lower housing section 104' as shown in FIG. 11D. The conductor cable 360 includes at least one conductor 370 that is shrouded by an insulating jacket 372. The jacket 372 may be composed of a variety of commonly used wire insulating materials, such as, for example ETFE (fluoropolymer resin), polymer plastics or the like.

The upper end of the conductor 370 terminates in a connector member 374 that includes a body 376 holding at least one connector 378. The body 376 is advantageously composed of an insulating material. A variety of commonly used electrical insulating materials may be used, such as, for example, teflon®, phenolic, peek plastic, nylon, epoxy potting or the like. The connectors 378 may be any of a large variety of electrical connectors used to join two conductors together, such as, for example, pin-socket connections or knife and sheath connections to name just a few. The lower end of the conductor 370 similarly terminates in a connector member 380 that is similarly provided with a body 382 and one or more connectors 384. The joining of the conductor 370 and the connectors 378 and 384 may be by soldering, crimping or other well known fastening techniques.

The conductor or conductors 370 may be shrouded with an external insulating jacket 386 that serves to keep the individual conductors 370 in close proximity and provides additional protection to the conductors 370 from nicking and other wear. The jacket 386 may be composed of a variety of commonly wire insulating materials, such as, for example ETFE (fluoropolymer resin), polymer plastics or the like.

Note that the conductor cable 360 is operable to elongate so that when the mandrel 12 is moved telescopically upward relative to the housing 14, the conductor cable 360 is not inadvertently disconnected from the connector members 374 and 380. This ability to elongate may be provided in a variety of different ways. In the illustrated embodiment, the lower end of the conductor cable 360 is provided with a plurality of coils 388. Depending upon the stiffness of the conductor cable 360, the coils 388 may exhibit a shape memory effect, that is, following tool firing and return of the mandrel 12 to the position shown in FIGS. 11A–11D, the coils 388 may contract automatically back to the condition shown in FIG. 11D.

In this illustrative embodiment, the fluid chamber 20 is pressure compensated by the pressure compensating piston 122 and annulus pressure through the vent 124 as generally described above. However, and like the embodiment illustrated in FIGS. 8A–8C, the lower end of the intermediate housing section 100' is not in fluid communication with the fluid chamber 234. The interface between the lower end of the intermediate housing section 100' and the mandrel segment 18 is again sealed by the loaded lip seal 332 and the O-ring 330. The mandrel segment 18 is provided with an expanded diameter section 340 that is slightly smaller than the internal diameter of the adjacent wall of the intermediate housing section 102'. This interface is sealed against fluid passage by an O-ring 342 and a loaded lip seal 344. The intermediate housing section 102' is provided with a reduced internal diameter portion 345. The interface between the portion 345 and the lower end of the mandrel segment 18 is sealed against the passage of annulus fluid by a loaded lip seal 346 and an O-ring 348. The expanded diameter section 340 and the portion 345 generally define a chamber 350 that is vented to the well annulus by a vent 352. The pressure area of the expanded diameter section 340 is selected to be the same as the pressure area of the mandrel segment 16 exposed to annulus pressure at 354 as shown in FIG. 11A. In this way, the tool 10'''' is hydrostatically balanced and the chamber 234 may be an atmospheric chamber filled with air or some other gas. This configuration thus eliminates the need for the dielectric fluid and the pressure compensating piston 236 depicted in FIG. 1D.

The skilled artisan will appreciate that the various embodiments in accordance with the present invention provide for through-tool electrical transmission in a tool capable of telescoping movement. Pressure compensation in any of the illustrative embodiments may be provided by way of, for example, a pressure compensated non-conducting fluid chamber or by matched pressure areas on the tool mandrel 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A downhole tool, comprising:

a housing;

a mandrel telescopically positioned in the housing and having an electrically insulating coating, the mandrel and the housing defining a pressure compensated substantially sealed chamber containing a volume of a non-conducting fluid;

a conductor member insulatingly coupled to the housing, a portion of the conductor member being electrically insulated from an ambient fluid by the non-conducting fluid; and a first biasing member for maintaining a conducting pathway between the mandrel and the conductor member.

2. The downhole tool of claim 1, wherein the conductor member is telescopically positioned in the mandrel.

3. The downhole tool of claim 1, wherein the first biasing member comprises a spring.

4. The downhole tool of claim 1, wherein the mandrel comprises a first end with a first spring biased contact member and the conductor member comprises a first end with a second spring biased contact member.

5. The downhole tool of claim 1, comprising a second biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

6. A downhole tool, comprising:

a housing having an external vent;

a mandrel telescopically positioned in the housing and having an electrically insulating coating, the mandrel and the housing defining a chamber in fluid communication with the vent, the mandrel having a first pressure area in fluid communication with the chamber and a second pressure area of substantially equal area to the first pressure area whereby ambient fluid pressure acting on the first and second pressure areas hydrostatically balances the mandrel;

a conductor member insulatingly coupled to the housing and being electrically insulated from the ambient fluid; and a first biasing member for maintaining a conducting pathway between the mandrel and the conductor member.

7. The downhole tool of claim 6, wherein the conductor member is telescopically positioned in the mandrel.

8. The downhole tool of claim 6, wherein the first biasing member comprises a spring.

9. The downhole tool of claim 6, wherein the mandrel comprises a first end with a first spring biased contact member and the conductor member comprises a first end with a second spring biased contact member.

10. The downhole tool of claim 6, comprising a second biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

11. A downhole tool, comprising:

a housing;

a mandrel telescopically positioned in the housing, the mandrel and the housing defining a pressure compensated substantially sealed chamber containing a volume of a non-conducting fluid;

a conductor member positioned in the housing for providing an electrically conducting pathway, the conductor member having a first segment and a second segment, the first segment being moveable with the mandrel and relative to the second segment, a portion of the conductor member being electrically insulated from an ambient fluid by the non-conducting fluid; and a first biasing member for maintaining a conducting pathway between the first segment and the second segment.

12. The downhole tool of claim 11, wherein the first segment is coupled to the mandrel and the second segment is coupled to the housing.

13. The downhole tool of claim 11, wherein the first segment is telescopically positioned around the second segment.

14. The downhole tool of claim 11, comprising an insulating jacket positioned around a portion of the conductor member.

15. The downhole tool of claim 14, wherein the first segment is positioned inside the mandrel and insulated from the mandrel by the insulating jacket.

16. The downhole tool of claim 11, wherein the first biasing member comprises a spring.

17. The downhole tool of claim 11, wherein the conductor member comprises a first end with a first spring contact member and a second end with a second spring contact member.

18. The downhole tool of claim 11, comprising a second biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

19. A downhole tool, comprising:

a housing having an external vent;

a mandrel telescopically positioned in the housing, the mandrel and the housing defining a chamber in fluid communication with the vent, the mandrel having a first pressure area in fluid communication with the chamber and a second pressure area of substantially equal area to the first pressure area whereby ambient fluid pressure acting on the first and second pressure areas hydrostatically balances the mandrel;

a conductor member insulatingly positioned in the housing for providing an electrically conducting pathway, the conductor member having a first segment and a second segment, the first segment being moveable with the mandrel and relative to the second segment; and a first biasing member for maintaining a conducting pathway between the first segment and the second segment.

20. The downhole tool of claim 19, wherein the first segment is coupled to the mandrel and the second segment is coupled to the housing.

21. The downhole tool of claim 19, wherein the first segment is telescopically positioned around the second segment.

22. The downhole tool of claim 19, comprising a pressure compensated substantially sealed chamber in the housing containing a volume of a non-conducting fluid, the non-conducting fluid maintaining electrical isolation between a portion of the conductor member and an ambient fluid.

23. The downhole tool of claim 19, comprising an insulating jacket positioned around a portion of the conductor member.

24. The downhole tool of claim 23, wherein the first segment is positioned inside the mandrel and insulated from the mandrel by the insulating jacket.

25. The downhole tool of claim 19, wherein the first biasing member comprises a spring.

26. The downhole tool of claim 19, wherein the conductor member comprises a first end with a first spring contact member and a second end with a second spring contact member.

27. The downhole tool of claim 19, comprising a second biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

28. A downhole tool, comprising:

a housing;

a mandrel telescopically positioned in the housing, the mandrel and the housing defining a pressure compensated substantially sealed chamber containing a volume of a non-conducting fluid; and a conductor cable positioned in the housing for providing an electrically conducting pathway through the housing, the conductor cable being sealed from the ambient fluid pressure and having a sufficient length whereby the conductor cable is operable to elongate when the mandrel and the housing are telescopically moved away from one another.

29. The downhole tool of claim 28, wherein the conductor cable is coupled to the mandrel.

30. The downhole tool of claim 28, wherein the conductor cable comprises at least one conductor having a first insulating jacket.

31. The downhole tool of claim 30, comprising a second insulating jacket around the first insulating jacket.

32. The downhole tool of claim 30, comprising a first connector member coupled to a first end of the conductor cable and a second connector member coupled to a second end of the conductor cable.

33. The downhole tool of claim 32, wherein the first and second connector members comprise a body holding at least one connector coupled to the at least one conductor.

34. The downhole tool of claim 28, comprising a first biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

35. A downhole tool, comprising:

a housing having an external vent;

a mandrel telescopically positioned in the housing, the mandrel and the housing defining a chamber in fluid communication with the vent, the mandrel having a first pressure area in fluid communication with the chamber and a second pressure area of substantially equal area to the first pressure area whereby ambient fluid pressure acting on the first and second pressure areas hydrostatically balances the mandrel; and a conductor cable positioned in the housing for providing an electrically conducting pathway through the housing, the conductor cable being sealed from the ambient fluid pressure and having a sufficient length whereby the conductor cable is operable to elongate when the mandrel and the housing are telescopically moved away from one another.

36. The downhole tool of claim 35, wherein the conductor cable is coupled to the mandrel.

37. The downhole tool of claim 35, wherein the conductor cable comprises at least one conductor having a first insulating jacket.

38. The downhole tool of claim 37, comprising a second insulating jacket around the first insulating jacket.

39. The downhole tool of claim 37, comprising a first connector member coupled to a first end of the conductor cable and a second connector member coupled to a second end of the conductor cable.

40. The downhole tool of claim 39, wherein the first and second connector members comprise a body holding at least one connector coupled to the at least one conductor.

41. The downhole tool of claim 35, comprising a first biasing member positioned between the mandrel and the housing and being operable to resist axial movement of the mandrel in a first direction, a collet positioned in the housing for selectively engaging the mandrel, and a sleeve positioned around and being axially moveable relative to the collet, the sleeve having a reduced inner diameter portion at which the collet selectively expands radially to disengage the mandrel.

* * * * *